US006666183B2

(12) United States Patent
Abe et al.

(10) Patent No.: US 6,666,183 B2
(45) Date of Patent: Dec. 23, 2003

(54) V-TYPE INTERNAL COMBUSTION ENGINE

(75) Inventors: Norio Abe, Saitama (JP); Katsunori Takahashi, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 96 days.

(21) Appl. No.: 10/022,519

(22) Filed: Dec. 20, 2001

(65) Prior Publication Data

US 2002/0073980 A1 Jun. 20, 2002

(30) Foreign Application Priority Data

Dec. 20, 2000 (JP) ..... 2000-387707

(51) Int. Cl.[7] ..... F02F 7/00
(52) U.S. Cl. ..... 123/195 R; 123/572
(58) Field of Search ..... 123/195 R, 193.2, 123/572, 196 M

(56) References Cited

U.S. PATENT DOCUMENTS 4,480,600 A 11/1984 Gill
4,494,494 A 1/1985 Yahiro et al.
4,541,399 A * 9/1985 Tanaka et al. ..... 123/573
4,603,673 A 8/1986 Hiraoka et al.
4,656,991 A * 4/1987 Fukuo et al. ..... 123/572
4,771,745 A * 9/1988 Nakamura et al. ..... 123/196 R
4,790,287 A 12/1988 Sakurai et al.
4,947,812 A 8/1990 Inoue et al.
4,958,613 A * 9/1990 Hiraoka et al. ..... 123/572
5,115,791 A 5/1992 Dore
6,142,129 A * 11/2000 Hori et al. ..... 123/572

FOREIGN PATENT DOCUMENTS

JP 64-7209 2/1989

* cited by examiner

*Primary Examiner*—Mahmoud Gimie
(74) *Attorney, Agent, or Firm*—Birch, Stewart, Kolasch & Birch, LLP

(57) ABSTRACT

To provide a V-type internal combustion engine capable of forming a breather path having a sufficiently large flow path area without enlarging a cylinder block. A 5-cylinder V-type internal combustion engine includes a breather apparatus, a crankshaft having three crankpins and a cylinder block formed with a front bank of three cylinders and a rear bank of two cylinders. Two crankpins disposed at both ends are connected with two connecting rods connected to pistons fitted to cylinder bores formed in the front and the rear banks. A crankpin disposed in the middle is connected only with a connecting rod connected to a piston fitted to a cylinder bore formed at a middle of the front bank and in the rear bank. A breather path of a breather apparatus is formed at a space portion between the two cylinder bores at a position opposed to the cylinder bore in the middle.

21 Claims, 13 Drawing Sheets

V-TYPE INTERNAL COMBUSTION ENGINE

BACKGROUND OF THE INVENTION

The present invention claims the benefit of Japanese Patent Application No. 2000-387707, filed Dec. 20, 2000, the entirety of which is hereby incorporated by reference.

1. Field of the Invention:

The present invention relates to a V-type internal combustion engine having a breather apparatus for recirculating blowby gas from a crankcase to an intake system. In particular, the present invention relates to the arrangement of a breather path constituting the breather apparatus.

2. Description of Background Art:

A V-type internal combustion engine having a breather apparatus for recirculating blowby gas to an intake system has been disclosed in Japanese Utility Model Publication No. 7209/1989. The breather apparatus is provided with a breather chamber provided at a bottom wall portion of a V-bank. A hole communicates the crankcase with the breather chamber. Furthermore, a communication path is formed at a cylinder wall of the cylinder block for communicating the breather chamber and a valve operating chamber, which is in communication with an intake manifold. Accordingly, blowby gas from the crankcase is recirculated to the intake manifold via the breather chamber, the communication path and the valve operating chamber.

In addition, according to the conventional breather apparatus, the communication path, which is also a breather path for flowing blowby gas, is formed in the cylinder wall on an inner side of the V-bank. Therefore, a flow path area of the communication path is limited. Accordingly, in order to ensure a sufficient flow path area, a plurality of communication paths are formed. Alternatively, in order to increase the flow path area of the communication path, it is necessary to significantly bulge the cylinder wall formed with the communication path toward the inner side of the V-bank. Therefore, a width of the bank formed with the communication path is increased in a direction orthogonal to a direction of arrangement of the cylinders, increasing the size of the cylinder block and restricting the arrangement of an intake apparatus in a space formed by the V-bank. Accordingly, the internal combustion engine is increased in size

SUMMARY OF THE INVENTION

The present invention has been carried out in view of such a situation and it is an object thereof to provide a V-type internal combustion engine capable of forming a breather path having a sufficiently large flow path area without enlarging the cylinder block.

According to a first aspect of the present invention, a V-type internal combustion engine includes a breather apparatus for recirculating blowby gas from a crankcase to an intake system. A crankshaft having three or more crankpins includes a first, a second and a third crankpin contiguous with each other in a direction of a rotational axis line thereof. A cylinder block is formed with a first and a second bank which form a V-like shape. The first and the third crankpins are respectively connected with a first and a third connecting rod, respectively connected to a first and a third piston, respectively fitted to a first and a third cylinder bore formed at the first bank. The second crankpin is disposed between the first and the third crankpins, is connected only with a second connecting rod, connected to a second piston, fitted to a second cylinder bore formed at the second bank. Furthermore, the breather apparatus includes a breather path formed at a space portion between the first and the third cylinder bores in the first bank.

According to the first aspect of the present invention, in the first bank, the space portion formed between the first and the third cylinder bores which constitutes a position opposed to the second cylinder bore of the second bank, is provided with a minimum width in the direction of the rotational axis line to a degree slightly smaller than a diameter of the second cylinder bore. Therefore, a flow path area of the breather path formed at the space portion can be sufficiently increased without increasing a width of the first bank in the direction of the rotational axis line and a width in a direction orthogonal to an assumed plane including the rotational axis line and a center line of the first cylinder bore or the third cylinder bore. Accordingly, a width of the cylinder block in the direction of the rotational axis line is not increased.

As a result, in the first bank, the breather path is formed at the space portion having a minimum width in the direction of the rotational axis line to the degree slightly smaller than the diameter of the second cylinder bore. Therefore, the breather path having a sufficiently large flow path area is provided without enlarging the first bank in the direction of the rotational axis line and in the direction orthogonal to the assumed plane. Accordingly, the cylinder block is not enlarged and the weight of the cylinder block is reduced. Furthermore, by increasing the flow path area of the breather path, a flow rate of blowby gas flowing through the breather path can be kept to a minimum. Therefore, separation of lubricating oil mist mixed in the blowby gas is expedited.

According to a second aspect of the present invention, there is provided a V-type internal combustion engine having an odd number of cylinders including a breather apparatus for recirculating blowby gas from a crankcase to an intake system. A crankshaft having a plurality of crankpins includes a first and a second crankpin contiguous with each other in a direction of a rotational axis line thereof. A cylinder block is formed with a first bank having an odd number of cylinders and a second bank having an even number of cylinders which form a V-like shape. The first crankpin is connected with a first and a second connecting rod, respectively connected to a first and a second piston, respectively fitted to a first and a second cylinder bore, respectively formed at the first and the second banks. The second crankpin is connected only with a third connecting rod, connected to a third piston, fitted to a third cylinder bore, formed in a bank having a larger number of the cylinders. The breather apparatus includes a breather path formed at a space portion contiguous with the same side at which the second crankpin is contiguous to the first crankpin relative to the first cylinder bore in the bank having a smaller number of the cylinders.

According to the second aspect of the present invention, in the bank having the smaller number of the cylinders, the space portion contiguous with the first cylinder bore or the second cylinder bore disposed at a position opposed to the third cylinder bore of the bank having the larger number of the cylinders, is provided with a width in the direction of the rotational axis line to a degree slightly smaller than a diameter of the third cylinder bore within a range such that the bank having the smaller number of cylinders does not project to the bank having the larger number of the cylinders in the direction of the rotational axis line. A flow path area of the breather path formed at the space portion can sufficiently be increased without increasing a width of the bank having the smaller number of the cylinders in a direction orthogonal to an assumed plane including the rotational axis line and a center line of the first cylinder bore or the second cylinder bore. Accordingly, a width of the cylinder block in the direction of the rotational axis line is not increased. Furthermore, the width in the direction of the rotational axis line is reduced by coupling the two connecting rods to the first crankpin.

As a result, in the bank having the smaller number of cylinders, the breather path is formed at the space portion having the width in the direction of the rotational axis line to a degree slightly smaller than the diameter of the third cylinder bore within the width in the direction of the rotational axis line of the bank having the larger number of cylinders. Therefore, a breather path having a sufficiently large flow path area is provided without enlarging the bank having the smaller number of cylinders in the direction orthogonal to the assumed plane including the rotational axis line and the center line of the cylinder bore. Accordingly, the advantage of the cylinder block being downsized by coupling the two connecting rods to the first crankpin is not deteriorated. Furthermore, by increasing the flow path area of the breather path, a flow rate of blowby gas flowing in the breather path can be kept to a minimum and therefore, the separating of lubricating oil mist mixed in the blowby gas can be expedited.

According to a third aspect of the present invention, there is provided the V-type internal combustion engine according to the second aspect of the present invention, wherein the crankshaft includes a third crankpin contiguous with a side opposed to the side at which the first crankpin is contiguous with the second crankpin. The third crankpin is connected with a fourth and a fifth connecting rod, respectively connected to a fourth and a fifth piston, respectively connected to a fourth and fifth cylinder bore, respectively formed at the first and the second banks. Furthermore, the space portion is present between the first and the fourth cylinder bores or between the second and the fifth cylinder bores.

According to the third aspect of the present invention, in the bank having the smaller number of cylinders, the space portion formed between the first and the fourth cylinder bores or between the second and the fifth cylinder bores, is provided with a minimum width in the direction of the rotational axis line to a degree slightly smaller than the diameter of the third cylinder bore and within the range of a width of the bank having the larger number of cylinders in the direction of the rotational axis line. Therefore, the flow path area of the breather path formed at the space portion can be sufficiently increased without increasing the width of the bank having the smaller number of cylinders in the direction of the rotational axis line and accordingly, without increasing the width of the cylinder block in the direction of the rotational axis line, the width in the direction of the rotational axis line being reduced by coupling the two connecting rods to each of the first and the third crankpins.

As a result, in addition to the advantages according to the second aspect of the present invention, a breather path having a sufficiently large flow path area is provided without enlarging the bank having the smaller number of cylinders in the direction of the rotational axis line and accordingly, without deteriorating the advantage of the cylinder block being downsized by coupling the two connecting rods to each of the first and the third crankpins. Furthermore, the weight of the cylinder block is reduced.

According to a fourth aspect of the present invention, in the V-type internal combustion engine according to any one of the first through third aspects of the present invention, the space portion is formed with a return path for lubricating oil and a partition wall is provided between the breather path and the return path such that the breather path and the return oil path are in parallel with each other in the direction of the rotational axis line.

According to the fourth aspect of the present invention, the space portion is provided with a minimum width in the direction of the rotational axis line to a degree slightly smaller than the diameter of the cylinder bore within a range such that the bank having the smaller number of cylinders does not project to the bank having the larger number of cylinders in the direction of the rotational axis line. In addition, the return path for lubricating oil having a sufficiently large flow path area can be formed in addition to the breather path having a sufficient blow path area without enlarging the cylinder block. Furthermore, the blowby gas and the lubricating oil can be prevented from mixing together by the partition wall, which partitions the breather path and the return oil path to be in parallel with each other in the direction of the rotational axis line.

As a result, the breather path and the return oil path are formed at the space portion having a minimum width in the direction of the rotational axis line to a degree slightly smaller than the diameter of the cylinder bore such that they do not project in the direction of the rotational axis line relative to the bank having the larger number of cylinders. Accordingly, the return oil path having a sufficient flow path area is provided along with the breather path without enlarging the cylinder block and the lubricating oil therefore returns smoothly. Furthermore, the blowby gas and the lubricating oil can be prevented from mixing together by the partition wall and an amount of the lubricating oil mist mixed into the blowby gas can be reduced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

An explanation will now be provided for embodiments of the present invention with reference to the accompanying drawings.

Figure 1:
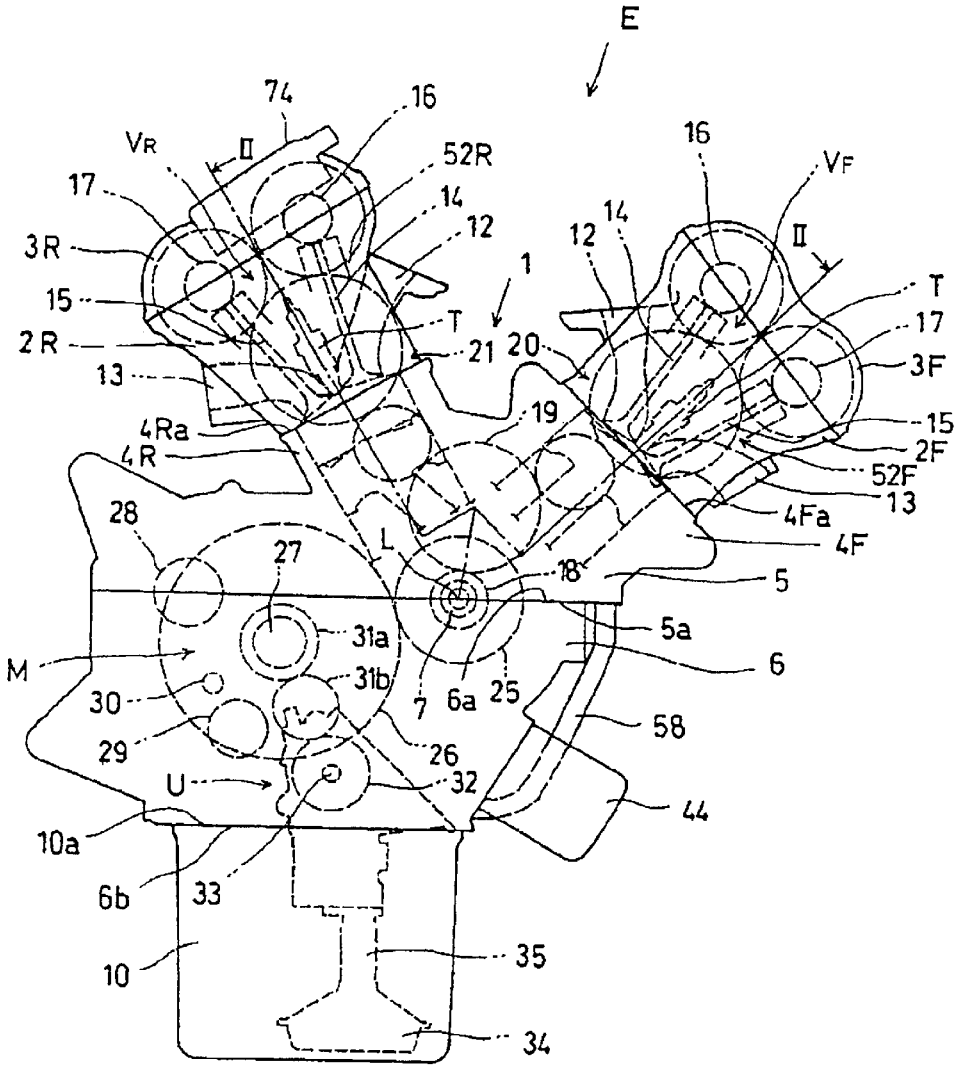
FIG. 1 is a right side view of a V-type internal combustion engine to which the present invention is applied.

Referring to FIGS. 1 through 5, a V-type internal combustion engine E to which the present invention is applied, is a V-type 5-cylinder 4-cycle internal combustion engine of a dual overhead cam (DOHC) type. The engine is also a water-cooled type, and which constitutes a power apparatus mounted to a motorcycle along with a transmission apparatus for transmitting power to rear wheels. As illustrated in FIG. 1, the internal combustion engine E is provided with, in a front and rear direction, a cylinder block 1 having a front bank 4F and a rear bank 4R forming a V-bank in a V-like shape having an angle of substantially 75°. A front cylinder head 2F and a rear cylinder head 2R are fastened to upper end faces 4F*a* and 4R*a* of the cylinder block 1 at the respective banks 4F and 4R. A front head cover 3F and a rear head cover 3R are respectively fastened to the two cylinder heads 2F and 2R. Furthermore, a lower portion of the cylinder block 1 is formed with an upper crankcase 5 and an upper portion thereof is formed with the two banks 4F and 4R, respectively. Furthermore, a lower end face 5*a* of the upper crankcase 5 is matched with an upper end face 6*a* of a lower crankcase 6 to thereby fasten the cylinder block 1 and the lower crankcase 6. Furthermore, a crankshaft 7 is transversely arranged in a left and right direction of a vehicle body, and is rotatably supported by the crankcase constituted by the upper crankcase 5 and the lower crankcase 6 in a state in which a rotational axis line L thereof is disposed on a match face of the lower end face 5*a* of the upper crankcase 5 and the upper end face 6*a* of the lower crankcase 6. Furthermore, in the specification, the terms "front, rear, left, right" signify "front, rear, left, right" with respect to the vehicle body.

Figure 5:
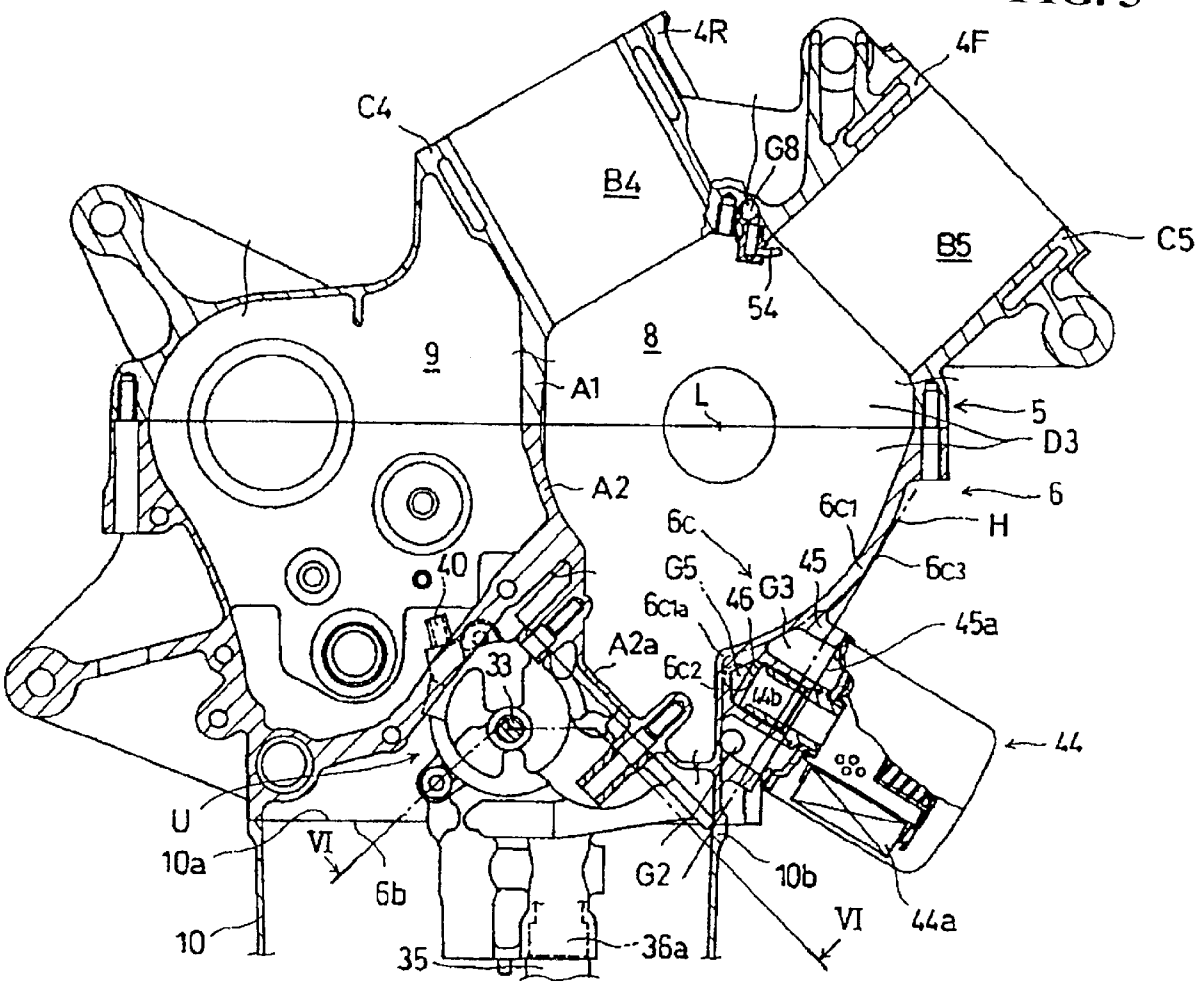
FIG. 5 is a sectional view of the cylinder block and the lower crankcase taken along a line V—V of FIG. 3.

Furthermore, with reference to FIG. 5, a front portion of the upper crankcase 5 and a front portion of the lower crankcase 6 forms the crankcase 8 containing the crankshaft 7. Furthermore, a rear portion of the upper crankcase 5 and a rear portion of the lower crankcase 6 forms a transmission chamber 9 containing a wet type multi-plate friction clutch (not illustrated) and a gear transmission M of an always in-mesh type constituting a transmission apparatus. The lower end face 6*b* of the lower crankcase 6 is matched with an upper end face 10*a* of an oil pan 10 in oil tight relationship to thereby fasten the oil pan 10.

Furthermore, the crankcase 8 and the transmission chamber 9 are separated by a bearing portion D1 constituting a left side wall and a bearing portion D4 constituting a right side wall (refer to FIG. 2) constituting two side walls of the cylinder block 1 and the lower crankcase 6. The crankcase 8 and the transmission chamber 9 are separated by a partition wall comprising an upper partition wall A1 formed at the cylinder block 1 and a lower partition wall A2 formed at the lower crankcase 6 to thereby constitute chambers independent from each other. Accordingly, the crankcase 8 is hermetically closed.

Figure 2:
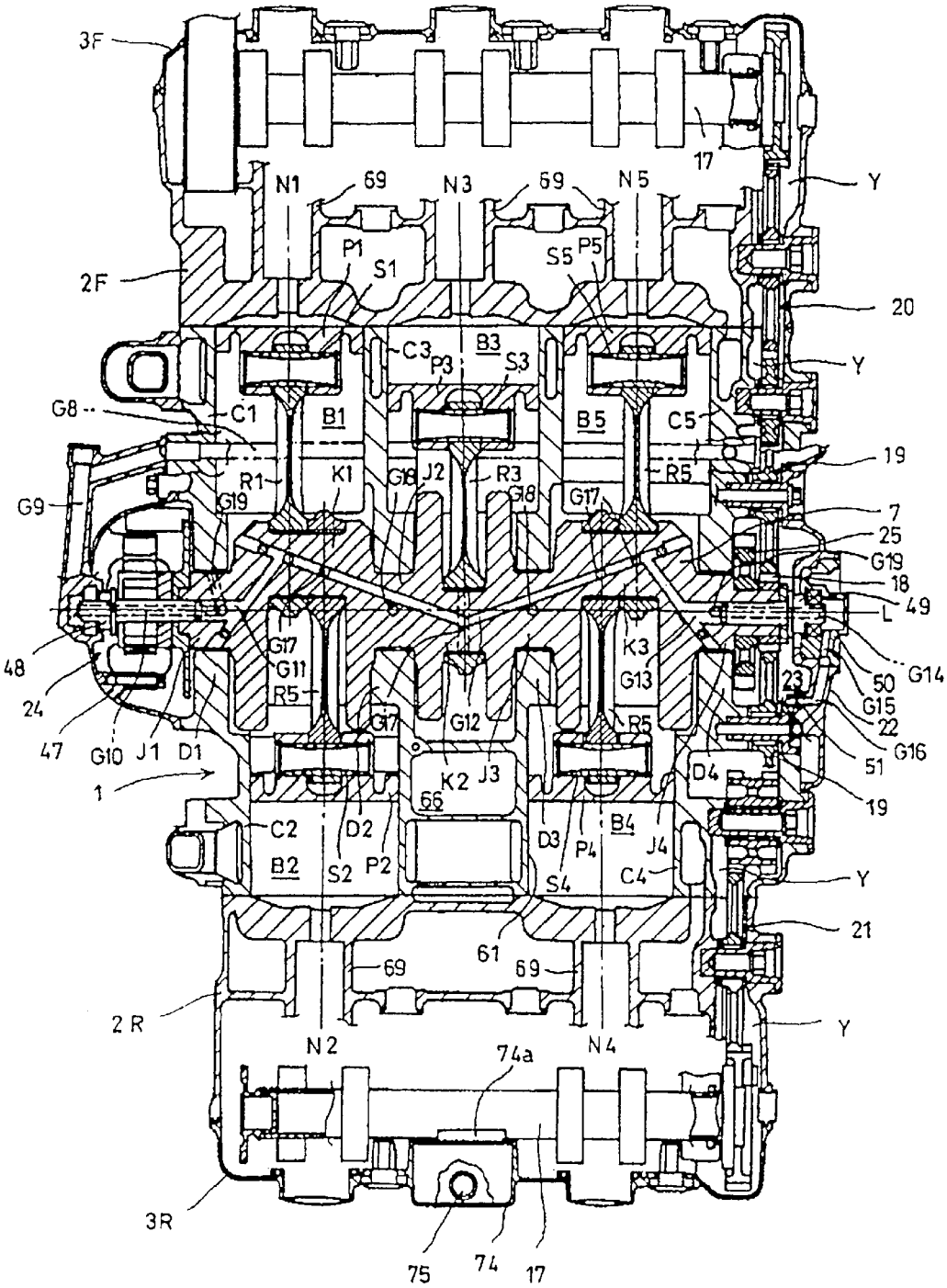
FIG. 2 is a sectional view substantially taken along a line II—II of FIG. 1.

Also with reference to FIG. 2, the front bank 4F is provided with three cylinders C1, C3 and C5 aligned and integrally coupled in the direction of the rotational axis line L of the crankshaft 7. Furthermore, center lines N1, N3 and N5 of the cylinder bores B1, B3 and B5 formed at the respective cylinders C1, C3 and C5, are directed from the rotational axis line L in skewed front upper directions and the respective cylinders C1, C3 and C5 are inclined forwardly. Furthermore, the rear bank 4R is provided with two cylinders C2 and C4 aligned and integrally coupled along the direction of the rotational axis line L. Center lines N2 and N4 of cylinder bores B2 and B4 formed at the respective cylinders C2 and C4 are directed from the rotational axis line L in skewed rear upper directions and the respective cylinders C2 and C4 are inclined rearwardly. Pistons P1 through P5 are slidably fitted in the cylinder bores B1 through B5 of the respective cylinders C1 through C5. The pistons P1 through P5 are reciprocated by combustion pressure from combustion chambers formed between the respective pistons P1 through P5 and the cylinder heads 2F and 2R. The pistons P1 through P5 rotate the crankshaft 7 via connecting rods R1 through R5 connecting the respective pistons P1 through P5 and the crankshaft 7.

Specifically, the crankshaft 7 is supported by the cylinder block 1 and the lower crankcase 6 by four bearing portions D1 through D4 respectively formed in the direction of the rotational axis line L at predetermined intervals at journals J1 through J4 via main bearings 11. Furthermore, the crankcase 8 is partitioned into three chambers in the direction of the rotational axis line L with the two bearing portions D1 and D4 being located at the ends and the two bearing portions D2 and D3 being disposed in the middle.

In the crankshaft 7, a crankpin K1 between the bearing portion D1 and the bearing portion D2, is connected with both of the connecting rods R1 and R2 connected to piston pins S1 and S2 of the two pistons P1 and P2. A crankpin K2 disposed between the bearing portion D2 and the bearing portion D3 and contiguous with the crankpin K1, is connected only with the connecting rod R3 connected to a piston pin S3 of the piston P3. Furthermore, a crankpin K3 disposed between the bearing portion D3 and the bearing portion D4 and contiguous with the crankpin K2, is connected with both of the connecting rods R4 and R5 connected to a fourth and a fifth piston pin S4 and S5 of the two pistons P4 and P5.

Referring to FIG. 1, the respective cylinder heads 2F and 2R are formed with an intake port 12 having a pair of inlet ports opened toward the combustion chamber and an exhaust port 13 having a pair of outlet ports. The intake ports 12 and the exhaust ports 13 are provided with a pair of intake valves 14 respectively opening and closing the pair of inlet ports and a pair of exhaust valves 15 for opening and closing the pair of outlet ports. In addition, each of the cylinder heads 2F and 2R are provided with an ignition plug T facing inside of the respective combustion chamber, at the respective combustion chamber. Furthermore, in the front cylinder head 2F, an intake cam shaft 16 and an exhaust cam shaft 17 are rotatably supported by four cam holders arranged at intervals in the direction of the rotational axis line L. In the rear cylinder head 2R, the intake cam shaft 16 and the exhaust cam shaft 17 are rotatably supported by three cam holders arranged at intervals in the direction of the rotational axis line L. Furthermore, two sets of the two cam shafts 16 and 17 are respectively driven to rotate at a rotational number of ½ of that of the crankshaft 7 by power of the crankshaft 7 transmitted from an intermediate gear 19 in mesh with the drive gear 18 provided at a right end portion of the crankshaft 7 via a front side timing gear train 20 and a rear side timing gear train 21. The cam shafts 16 and 17 drive the respective intake valves 14 and the respective exhaust valves 15 at predetermined timings.

Furthermore, an intake apparatus connected to the respective intake ports 12, is arranged on the inner side of the V-bank. An exhaust pipe connected to the exhaust ports 13 of the cylinders C1, C3 and C5 of the front bank 4F, is extended in the rear direction by passing through a recess formed at the right side of the lower portion of the left wall of the oil pan 10.

Furthermore, as illustrated in FIG. 2, the drive gear 18 and the intermediate gears 19 disposed on the right side of the cylinder block 1 and the two cylinder heads 2F and 2R, are covered by a cover 22 attached to right side walls of the upper crankcase 5 and the lower crankcase 6. Two timing gear trains 20 and 21 are arranged in a cavity Y formed at right end portions of the two banks 4F and 4R of the cylinder block 1 and the two cylinder heads 2F and 2R. Therefore, the drive gear 18, the intermediate gears 19 and the two timing gear trains 20 and 21 are contained in a gear chamber 23 constituted by a space formed by the right side walls and the cover 22 and the cavity Y. The gear chamber 23 is in communication with the oil pan 10 via a cavity formed at the lower crankcase 6 formed therebelow (not illustrated). Furthermore, an alternator 24 is provided at a left end portion of the crankshaft 7.

Referring to FIG. 1, the power of the crankshaft 7 is transmitted to the multi-plate friction clutch via a primary speed reducing mechanism comprising a primary drive gear 25 and a primary driven gear 26 and is transmitted further to the gear transmission M. A main shaft 27 and a counter shaft 28 of the gear transmission M are respectively provided with a main gear group and a counter gear group, not illustrated. When a shift drum 29 is rotated by a speed change operating mechanism, shift forks engaged with cam grooves of the shift drum 29 are moved in the left and right direction on a support shaft 30. Gears of the main gear group and the gears of the counter gear group in correspondence with the speed change operation are brought in mesh with each other. The power of the crankshaft 7 is subjected to speed change and is transmitted from the main shaft 27 to the counter shaft 28 and power of the counter shaft 28 is transmitted to rear wheels via a secondary speed reducing mechanism having a chain (not illustrated).

Furthermore, the power of the crankshaft 7 is transmitted to a pump gear 32 provided at a drive shaft 33 of an oil pump unit U via an intermediate gear 31*b* in mesh with a pump drive gear 31*a* rotated integrally with the primary driven gear 26 rotatably supported by the main shaft 27 to drive the oil pump unit U. The left end of the drive shaft 33 is coupled with a rotating shaft provided with an impeller of a cooling water pump, not illustrated.

Figure 6:
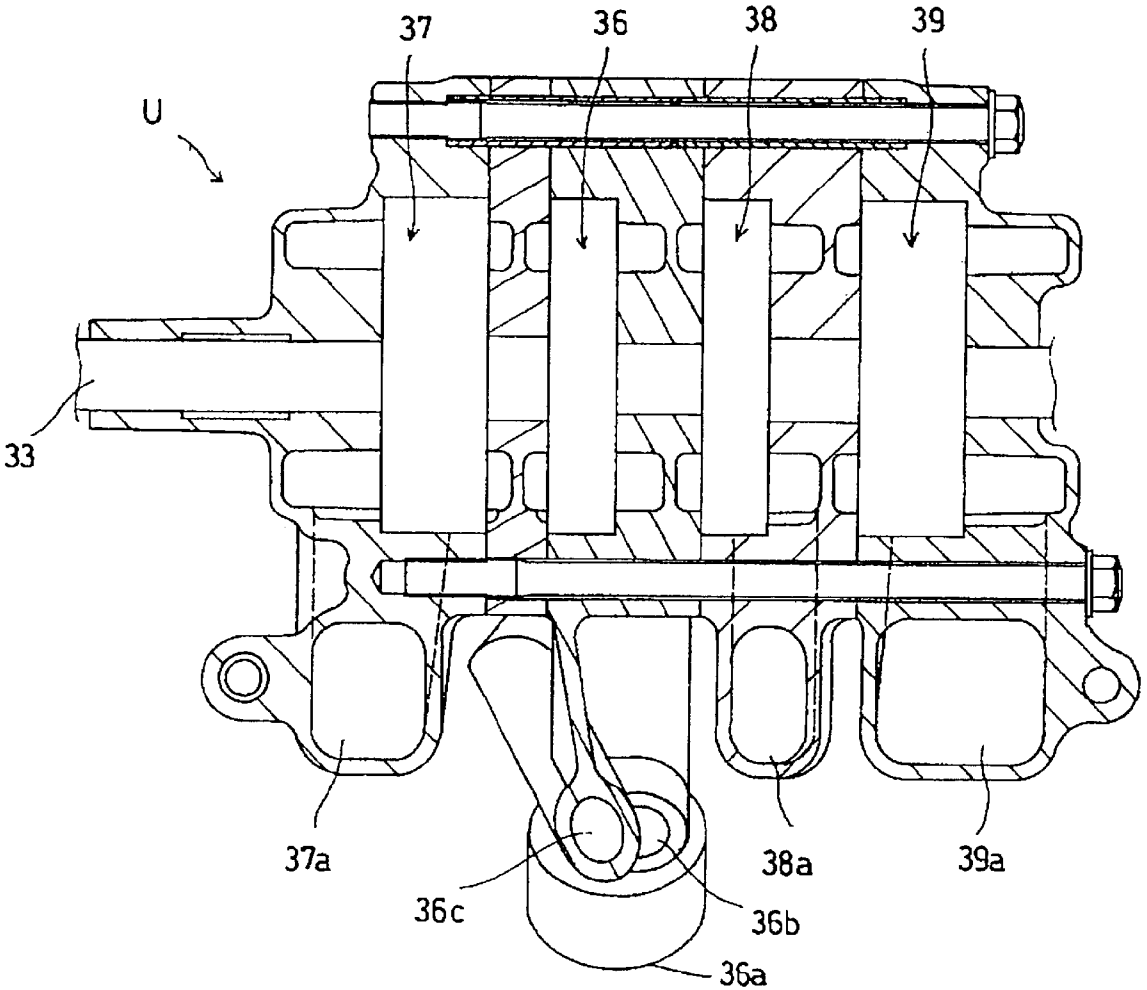
FIG. 6 is a sectional view taken along a line VI—VI of FIG. 5.

An explanation will now be given of a lubricating system for the power apparatus. An oil strainer 34 is arranged in the oil pan 10. An oil pipe 35 extends from the oil strainer 34 in the upper direction and is connected to a fourth intake port of a feed pump 36 of the oil pump unit U. Referring to FIGS. 5 and 6, the oil pump unit U is provided with a first scavenge pump 37, the feed pump 36, a second scavenge pump 38 and a third scavenge pump 39 in the axial direction of the drive shaft 33 successively from the right. The pumps 36 through 39 are constituted by trochoid pumps. The oil pump unit U is provided with a first intake port 37*a* of the first scavenge pump 37, a second intake port 38*a* of the second scavenge pump 38, a third intake port 39*a* of the third scavenge pump 39 and a single first delivery port 40 communicating with the respective delivery ports (not illustrated) of the first through the third scavenge pumps 37 through 39. Furthermore, the oil pump unit U is provided with a fourth input port 36*a* of the feed pump 36 and a relief port 36*b* provided with a relief valve and a second delivery port 36*c*. The first delivery port 40 is provided in the vicinity of the second scavenge pump 38 in the axial direction of the drive shaft 33 and is directed substantially toward the main shaft 27 of the gear transmission M.

Figure 7:
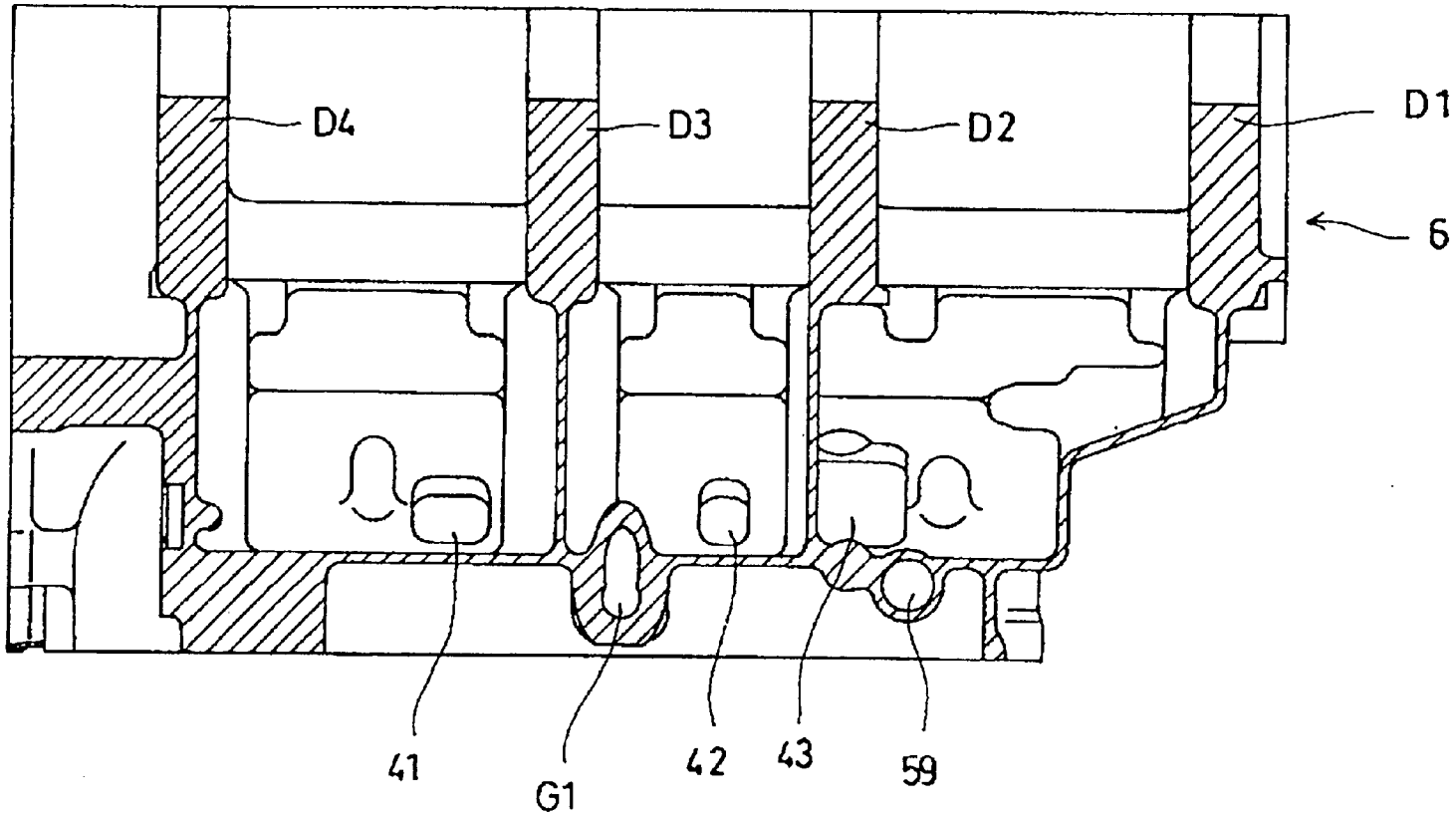
FIG. 7 is a sectional view taken along a line VII—VII of FIG. 4.

Referring to FIG. 5, the lower crankcase 6 is provided with an inclined partition wall A2*a* extending from a front portion of a lower end face 6*b* coupled with the oil pan 10 in a skewed rear upper direction and constituting an acute angle between the inclined partition wall A2*a* and a flat wall portion 6*c*2, described below, of a front wall 6*c* of the lower crankcase 6. The oil pump unit U is attached to an attaching face formed on the side of the oil pan 10 of the inclined partition wall A2*a* constituting a portion of the lower partition wall A2. In a state in which the oil pump unit U is attached to the attaching face, as illustrated in FIG. 7, the inclined partition wall A2*a* is provided with a first, a second and a third intake port 41, 42 and 43, respectively connected to the first, the second and the third input ports 37*a*, 38*a* and 39*a*. Furthermore, lubricating oil which is supplied into the crankcase 8, once lubricating necessary lubricating portions and flowing down to the bottom portion of the crankcase 8, is sucked respectively from the first through the third intake ports 41 through 43 to the first through the third scavenge pumps 37 through 39 and is discharged from the first delivery port 40 into the transmission chamber 9.

Figure 8:
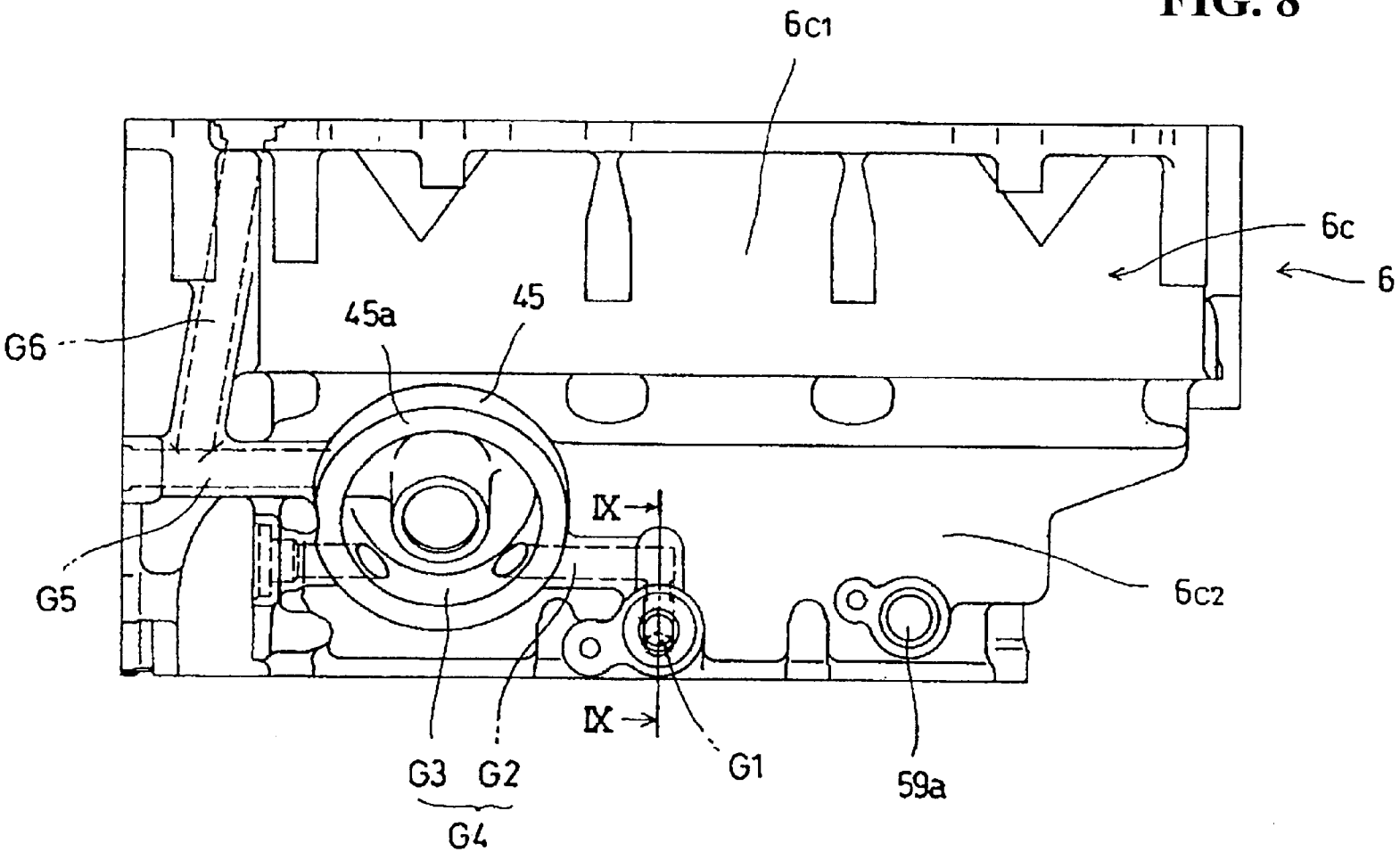
FIG. 8 is a front view of the lower crankcase viewed in the direction of an arrow VIII of FIG. 4.
Figure 9:
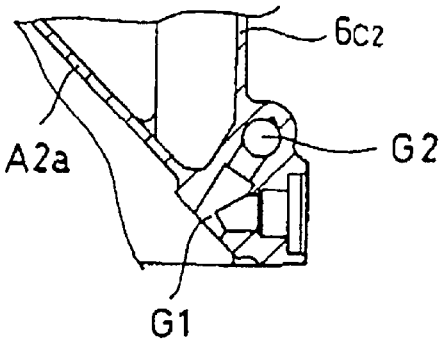
FIG. 9 is a sectional view taken along a line IX—IX of FIG. 8.

Furthermore, as illustrated in FIGS. 8 and 9, in the inclined partition wall A2*a*, at a position slightly upward from the lower end face 6*b*, there an oil path G1 is provided to the second delivery port 36*c* by coupling with an end face of the second delivery port 36*c*. The oil path G1 is connected to an oil path G2 constituting an introducing oil path G4, described below, for conducting the lubricating oil to an oil filter 44 for cleaning the lubricating oil by removing foreign matters in the lubricating oil by a filter element 44*a*. Referring to FIGS. 5 and 8, a cylindrical shaped oil filter 44 is attached to an attaching seat 45 formed at the front wall 6*c* of the lower crankcase 6. Specifically, the front wall 6*c* is provided with a partially cylindrical curved wall portion 6*c*1 constituting a portion in a peripheral direction of a substantially cylindrical peripheral wall with the rotational axis line L as a center line. The flat wall portion 6*c*2 substantially in a flat plate shape continuous with a lower end portion 6*c*1*a* of the curved wall portion 6*c*1 is disposed substantially right below the rotational axis line L and extends in a vertical lower direction to reach a lower end face 6*b*. A portion of the lower end face 6*b* in correspondence with the flat wall portion 6*c*2 is matched to the upper end face 11*a* at the front wall 10*b* portion in the flat plate shape of the oil pan 10.

The attaching seat 45 projects from front faces of the curved wall portion 6*c*1 and the flat wall portion 6*c*2 in a space formed by the curved wall portion 6*c*1 and the flat wall portion 6*c*2. An attaching face 45*a* attached with the oil filter 44, is disposed upward from the lower end face 6*b*, disposed rearward from a contact portion 6*c*3 of the front face in contact with an assumed plane H in contact with a frontmost portion of the lower end face 6*b* and a front face of the curved wall portion 6*c*1. Furthermore, the attaching face 45*a* is formed at a position slightly projected forward from the assumed plane H and substantially along the assumed plane H. Also with reference to FIG. 10, inside of the attaching seat 45 an oil path G3 is formed comprising a groove in a ring-like shape opened to the attaching face 45*a* and the oil path G2 one end of which is connected to the oil path G1 and other end of which is connected to a lower portion of the oil path G3 from a tangential direction of the oil path G3. An introducing oil path G4 is constituted by the oil path G2 and the oil path G3. The lubricating oil delivered from the feed pump 36 flows into the oil filter 44 via the introducing oil path G4.

Furthermore, at a central portion of a circular ring of the oil path G3, a screw hole 46 is formed with female threads in a direction orthogonal to the attaching face 45*a*. The screw hole 46 is threaded with a cylindrical shaped threaded portion 44*b* for forming an oil path to an inside of the oil filter 44. Furthermore, an introducing oil path G5 is formed opened to a peripheral wall in the vicinity of a bottom portion of the screw hole 46 and extends substantially in parallel with the rotational axis line L and accordingly, the lower end portion 6*c*1*a* of the curved wall portion 6*c*1 and to the right side of the screw hole 46 in the vicinity of the lower end portion 6*c*1*a*.

Figure 3:
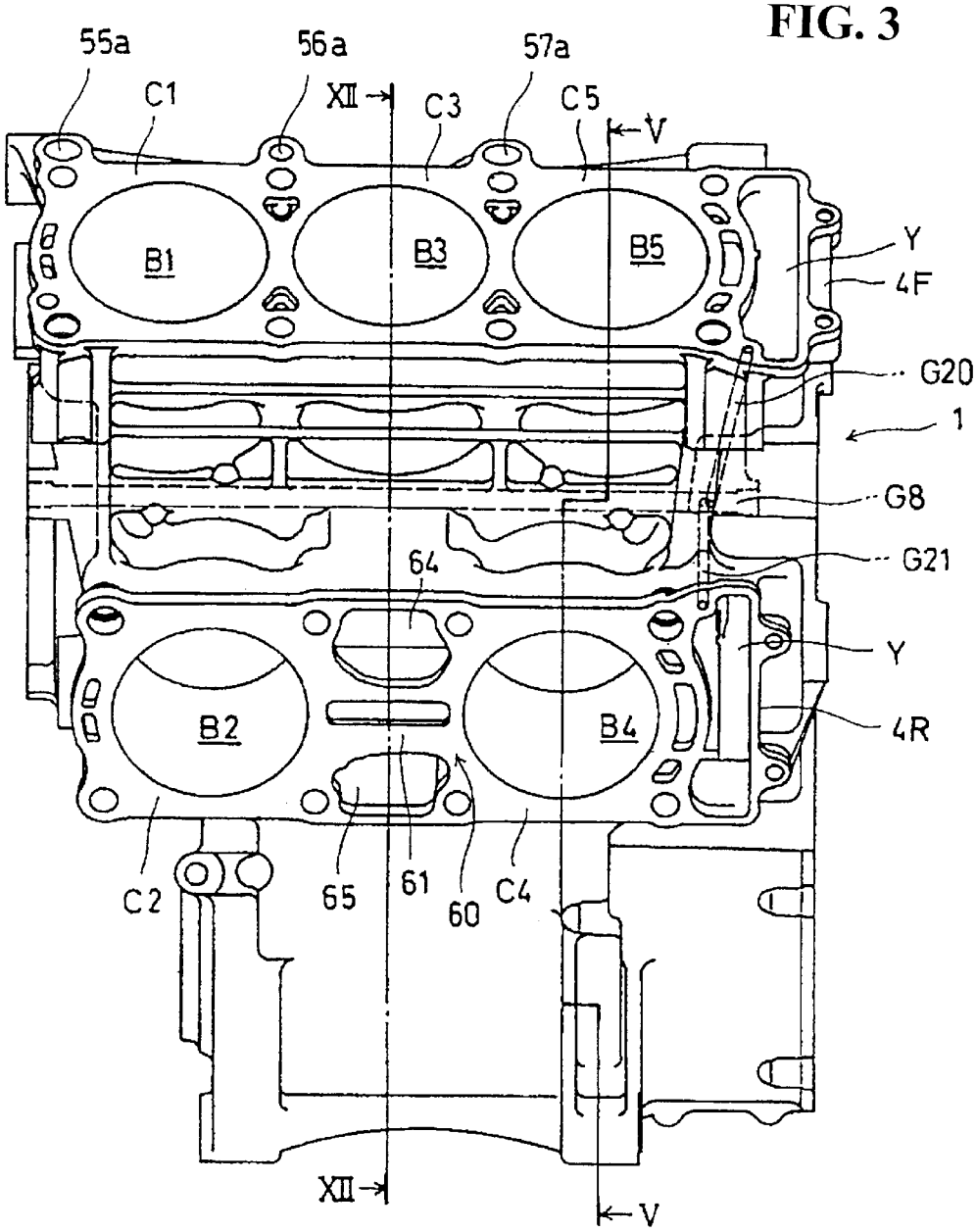
FIG. 3 is a plane view of a cylinder block of FIG. 1.
Figure 4:
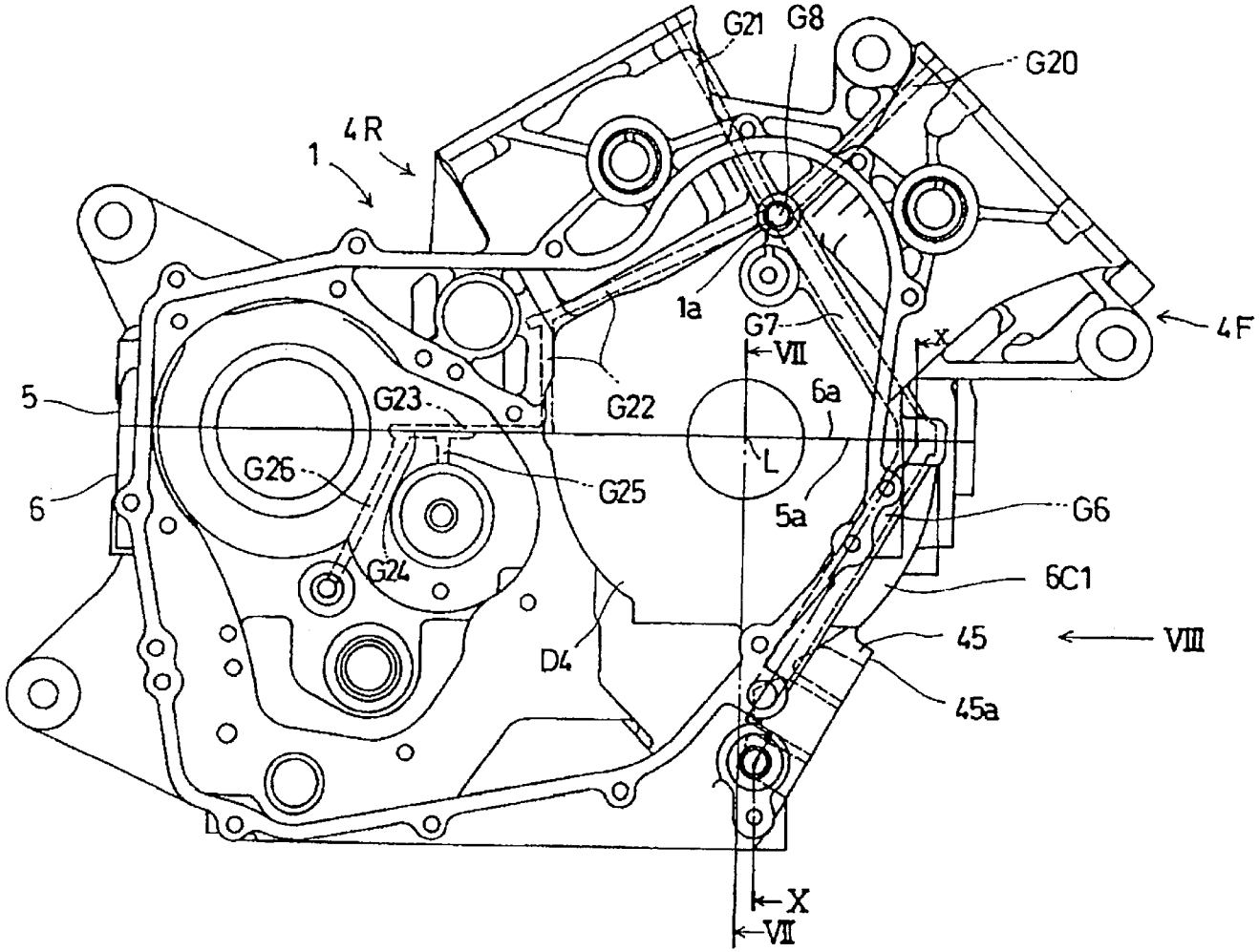
FIG. 4 is a right side view of the cylinder block and a lower crankcase of FIG. 1.
Figure 10:
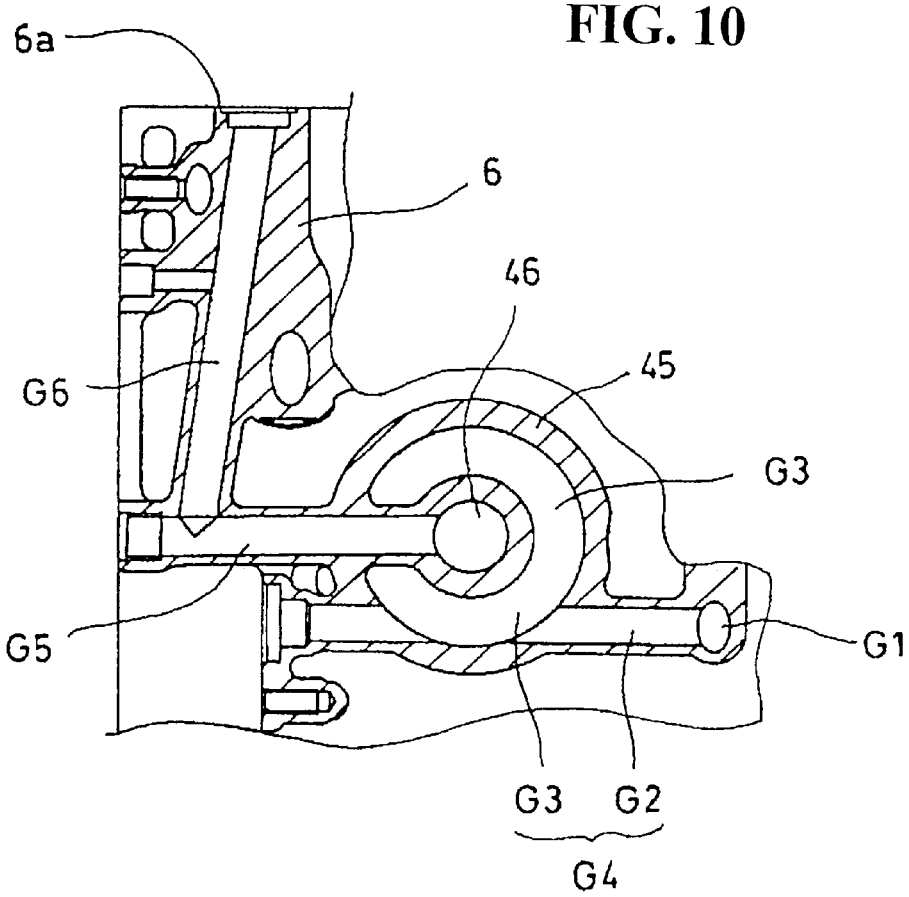
FIG. 10 is a sectional view taken along a line X—X of FIG. 4.

With reference to FIGS. 4 and 10, the introducing oil path G5 is connected to an oil path G6 formed at the front wall 6*c* and opened to the upper end face 6*a* at the right end portion of the lower crankcase 6. The oil path G6 is connected to one end of an oil path G7 formed at the right end portion of the cylinder block 1. The other end of the oil path G7 is connected to a main gallery G8 formed at a bottom wall portion 1*a* of the V-bank of the cylinder block 1 at the upper end face 6*a*. The main gallery G8 extends from a right end portion of the bottom wall portion 1*a* substantially in parallel with the rotational axis line L, opens at a left end face of the cylinder block 1 (refer to FIG. 3), as illustrated in FIG. 2, and is connected to an oil path G9 formed at an alternator cover 37 fastened to a left end face of the crankshaft 7. The oil path G9 is connected to an oil path G11 formed by utilizing a screw hole threaded with a bolt 48 of the crankshaft 7 via an oil path G10 formed at an inside of the bolt 48 for fixing a rotor of the alternator 24 to the crankshaft 7. Furthermore, the oil path G11 is connected with one end of an in-shaft oil path G12 formed at an inside of the crankshaft 7. The other end of the in-shaft oil path G12 is connected to an oil path G13 formed by utilizing a screw hole threaded with a bolt 49 for fixing a ring for hampering movement of the drive gear 18 in the direction of the rotational axis line L at the right end portion of the crankshaft 7. The oil path G13 is connected to an oil path G16 provided at the cover 22 via an oil path G14 formed at inside of the bolt 49. An oil path G15 is formed at a cap 50 mounted to the cover 22. The lubricating oil which has passed through the oil path G16 is injected from a nozzle 51 provided at the other end of the oil path G16 toward the intermediate gears 19, the drive gear 18 and the two timing gear trains 20 and 21.

Furthermore, the first through the third crankpins K1 through K3 are formed, in the diameter direction, with oil paths G17 connected to the in-shaft oil path G12 for supplying the lubricating oil to the connecting portions of the respective crankpins K1 through K3 connected with the connecting rods R1 through R5. The journals J2 and J3 are formed, in the diameter direction, with oil paths G18 connected to the in-shaft oil path G12 for supplying the lubricating oil to the bearing portions D2 and D3. Furthermore, the journals J1 and J4 are formed, in the diameter direction, with oil paths G19 respectively connected to the oil path G11 and the oil path G13 for supplying the lubricating oil to the two bearing portions D1 and D4.

Furthermore, referring to FIGS. 3 and 4, in the main gallery G8, at a portion thereof connected with the oil path G7, head oil paths G20 and G21 are formed extending from the connected portion to the cylinder heads 2F and 2R of the respective banks 4R and 4F in the cylinder block 1, by way of the respective head oil paths G20 and G21. The lubricating oil is supplied to a front valve operating apparatus VF constituted by the two cam shafts 16 and 17. Lifters and the like are arranged at an inside of a front valve operating chamber 52F formed by the front cylinder head 2F and the front head cover 3F. A rear valve operating chamber VR is constituted by the two cam shafts 16 and 17. Lifters and the like are arranged at an inside of a rear valve operating chamber 52R formed by the rear cylinder head 2R and the rear head cover 3R (refer to FIG. 1). That is, the respective head oil paths G20 and G21 are connected to oil paths formed at cam holders fixed to the respective cylinder heads 2F and 2R and disposed at right ends thereof at upper end faces 4F*a* and 4R*a*. The respective valve operating apparatus VF and FR are lubricated by lubricating oil supplied from the cam holders to hollow portions of the two cam shafts 16 and 17 and supplied from oil holes provided at necessary portions of the two cam shafts 16 and 17.

Figure 11:
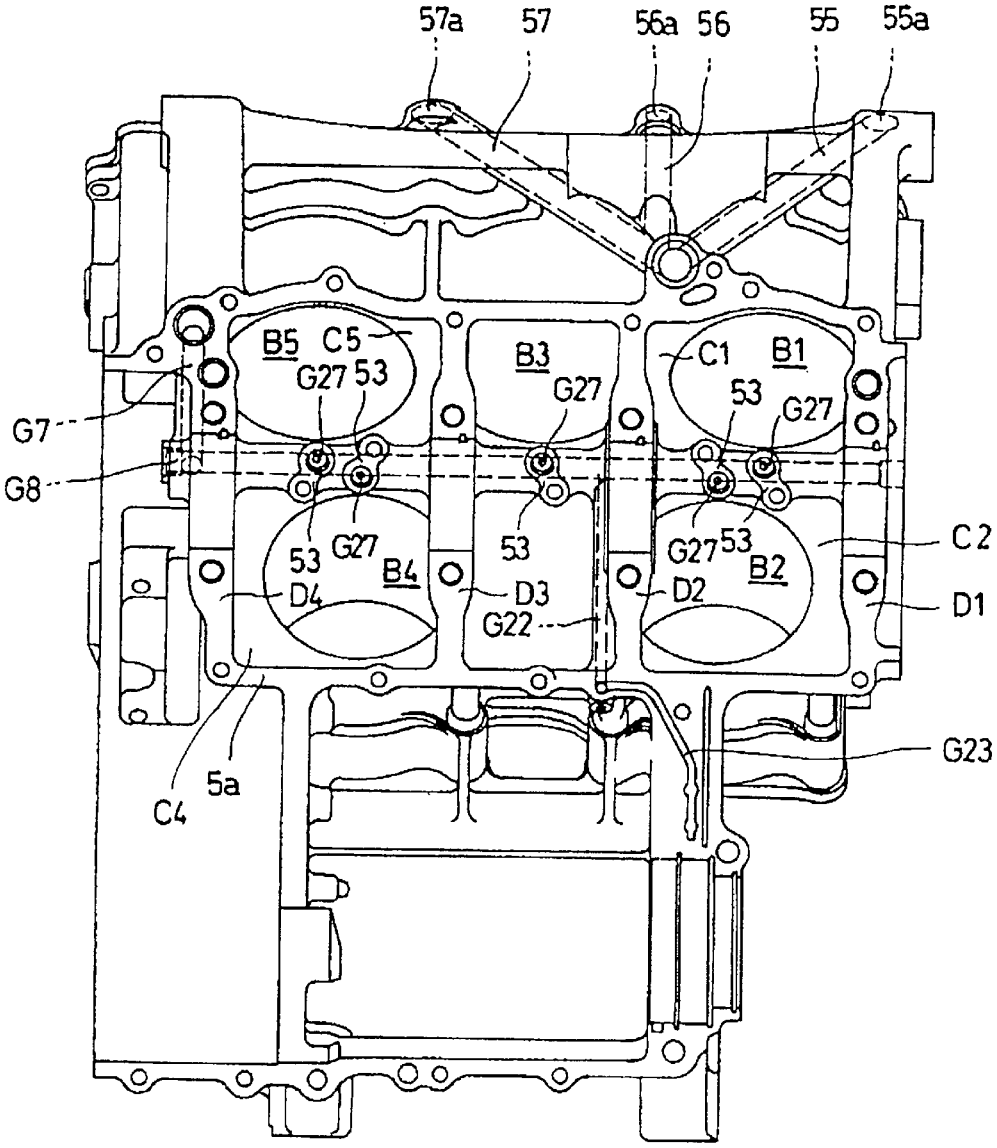
FIG. 11 is a bottom view of the cylinder block.

Furthermore, referring to FIGS. 4 and 11, at the main gallery G8, contiguous with the right side of the cylinder C2 of the rear bank 4R, an oil path G22 is formed opened to the lower end face 5*a* of the cylinder block 1 (lower crankcase 5). The oil path G22 branches, by way of an oil path 23 comprising a groove formed at the lower end face 5*a* of the cylinder block 1 and an oil path G24 comprising a groove formed at the upper end face 6*a* of the lower crankcase 6*a*, to pass an oil path G25 and an oil path G26 formed at the lower crankcase 6. The lubricating oil is supplied to the sliding portions of the main shaft 27 and the support shaft 30 of the gear transmission M.

Furthermore, referring to FIGS. 5 and 11, along the main gallery G8, at an inner face of the bottom wall portion 1*a* of the cylinder block 1, five mounting portions 53 are provided mounted with nozzles 54 (refer to FIG. 5) in correspondence with the respective cylinder bores B1 through B5 at portions including the center lines N1 through N5 of the respective cylinder bores B1 through B5 and intersected with assumed planes orthogonal to the rotational axis line L. By injecting the lubricating oil which has passed through oil paths G27 provided at the respective mounting portions 53 and connected to the main gallery G8 from the nozzles 54, the lubricating oil is supplied to the connecting portions of the respective pistons S1 through S5 and the respective connecting rods R1 through R5 and sliding portions of the respective cylinders C1 through C5 and the respective pistons P1 through P5.

An explanation will now be given of a return oil path of the lubricating oil and a breather apparatus.

First, with regard to the front bank 4F, referring to FIGS. 3 and 11, at the front wall of the cylinder head 2F, at a left side portion of the cylinder C1, that is, the left end portion of the front bank 4F, between the two cylinders C1 and C3 and between the two cylinders C3 and C5, a first, a second and a third return oil path 55, 56 and 57 of the lubricating oil are formed, respectively having opening portions 55*a*, 56*a* and 57*a* at the upper end face 4F*a* of the cylinder block 1. Furthermore, oil paths connected to the respective opening portions 55*a*, 56*a* and 57*a* are formed to open to an inside of the front valve operating chamber 52F. The lubricating oil which has finished lubricating the front valve operating apparatus VF is gathered at the lower portion of the cylinder block 1 by way of the first through the third return oil paths 55 through 57 formed at the front wall of the cylinder block 1, passes through a return oil pipe 58 (refer to FIG. 1) connected thereto at the lower end face 5*a* of the cylinder block 1 and returns to the oil pan 10 by way of an oil path 59 (refer to FIG. 7) having an opening portion 59*a* (refer to FIG. 8) provided below the flat wall portion 6*c*2 of the front wall 6*c* of the lower crankcase 6.

Figure 12:
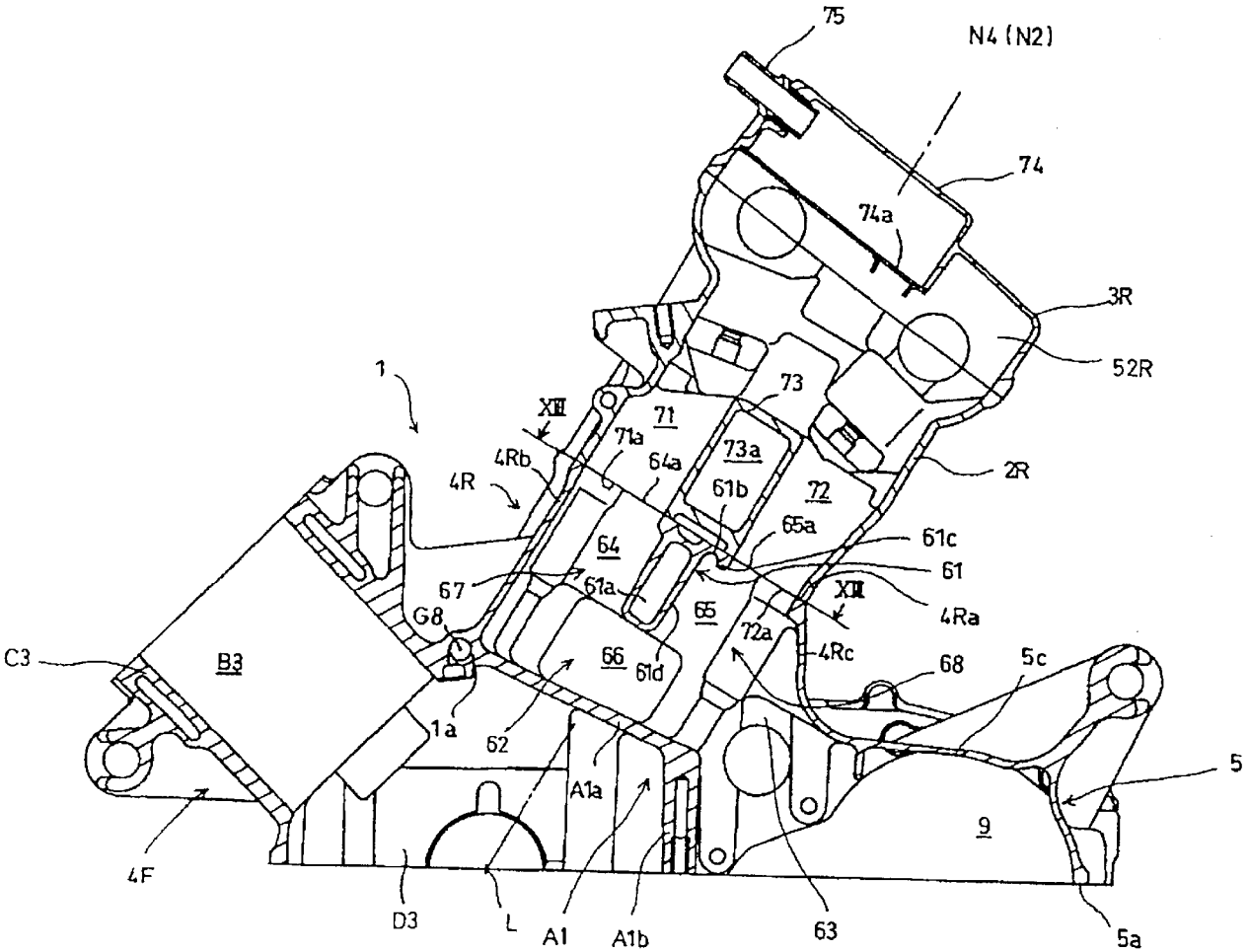
FIG. 12 is a view taken along a line XII—XII of FIG. 3.
Figure 13:
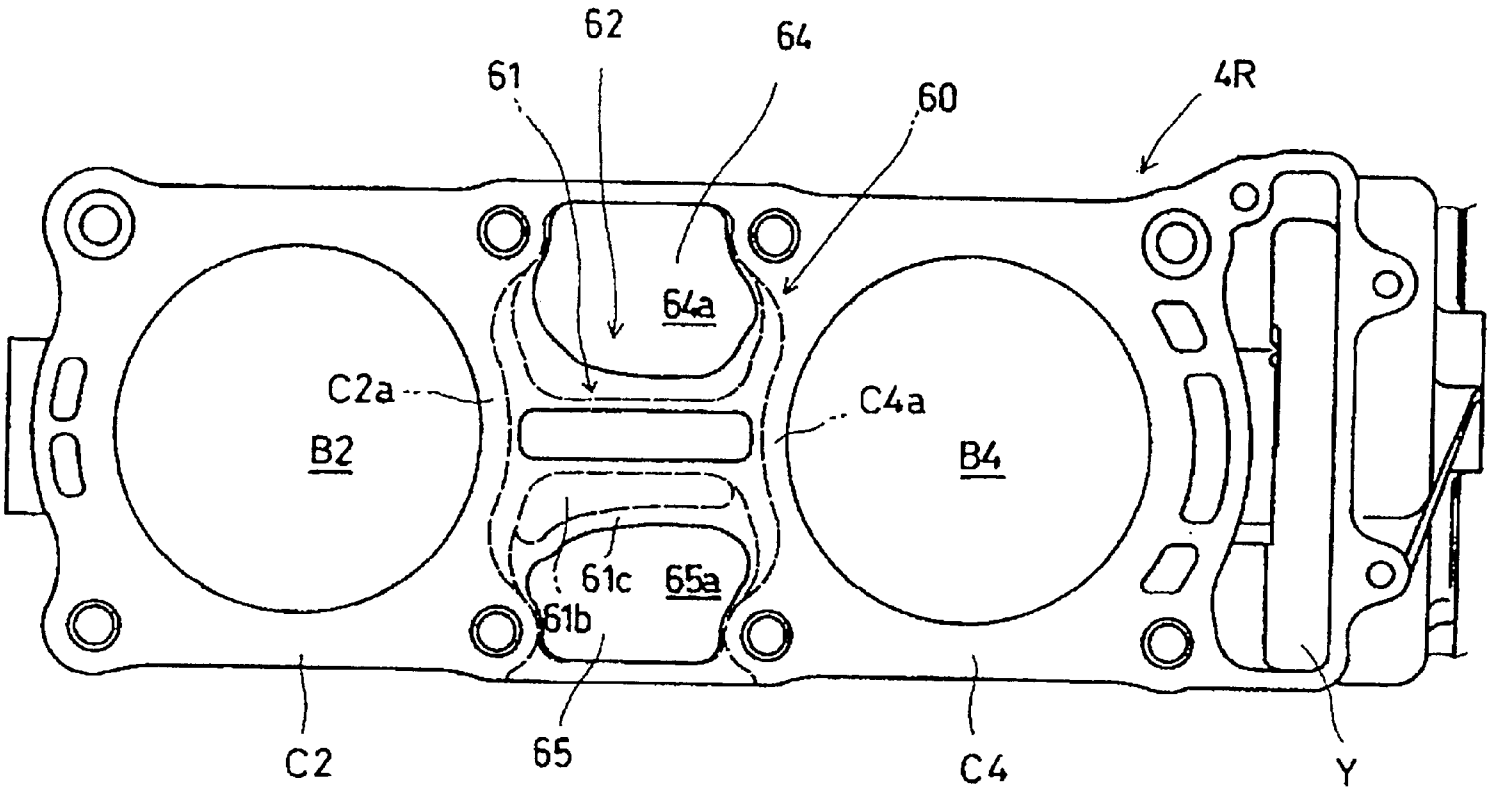
FIG. 13 is an end face view of a rear bank of the cylinder block in a direction XIII of FIG. 12.

In addition, referring to FIGS. 12 and 13, in the rear bank 4R, substantially in the front and rear direction, that is, in a direction orthogonal to an assumed plane including the rotational axis line L and dividing the V-bank in two, at a position opposed to the cylinder bore B3 of the front bank 4F, between the cylinder bore B2 and the cylinder bore B4 in the direction of the rotational axis line L, a space portion 60 is formed having a width in the direction of the rotational axis line L to a degree slightly smaller than the diameter of the cylinder bore B3 and substantially equal to an interval in the direction of the rotational axis line L between a central point of the journal J2 and a central point of the journal J3 in the direction of the rotational axis line L. As a result, as illustrated in FIG. 3, the space portions 60 is within a range such that it does not project relative to the front bank 4F in the direction of the rotational axis line L.

In the space portion 60, a cavity 62 is formed having a partition wall 61 extending substantially in parallel with the direction of the rotational axis line L and continuous with an outer peripheral wall C2*a* of the cylinder C2 and an outer peripheral wall C4*a* of the cylinder C4. The cavity 62 is formed between an inclined partition wall A1*a* constituting a portion of the upper partition wall A1, extending from the bottom wall portion 1*a* in a skewed rear lower direction and reaching a rear end of a lower portion of the rear bank 4R and an upper end face 4R*a* of the rear bank 4R, between the outer peripheral wall C2*a* of the cylinder C2 and the outer peripheral wall C4*a* of the cylinder C4 and between the inner side wall 4R*b* of the V-bank of the rear bank 4R and an outer side wall 4R*c* of the V-bank extending in a skewed rear lower direction and continuous to an upper wall 5C of the transmission chamber 9. Furthermore, between a vertical partition wall A1*b* extending from an end portion of the inclined partition wall A1*a* on the side of the transmission chamber 9 in the vertical lower direction toward the lower end face 5*a* and constituting the upper partition wall A1 and the outer side wall 4R*c* of the V-bank, an opening portion 63 is formed for communicating the cavity 62 and the transmission chamber 9. Furthermore, a width of the cavity 62 in the direction of the rotational axis line L is substantially equal to an interval between the bearing portion D2 and the bearing portion D3 in the rotating shaft direction. A width thereof in a direction orthogonal to an assumed plane including the rotational axis line L and the center line N2 or the center line N4 (hereinafter, referred to as "orthogonal" direction) is substantially equal to a width of the rear bank 4R in the orthogonal direction at portions of the cylinders C2 and C4.

Above the cavity 62, a path 64 is formed interposing the partition wall 61, extending to substantially a central portion of the upper end face 4R*a* and the inclined partition wall A1*a* in a direction of the center line N2 or the center line N4. The path 64 has an opening portion 64*a* at the upper end face 4R*a* on an inner side of the V-bank. A path 65 is formed having an opening portion 65*a* at the upper end face 4R*a* and constituting the opening portion 63 at its rear portion on an outer side of the V-bank. The paths 64 and 65 are arranged in parallel with the direction of the rotational axis line L by the partition wall 61. Furthermore, by a path 66 formed below the partition wall 61 and below the cavity 62, the path 64 and the opening portion 63 are in communication with each other. Furthermore, a breather path 67 of the cylinder block 1 is constituted by the opening portion 63, the path 66 and the path 64. A oil return path 68 of the lubricating oil from the rear valve operating chamber 52R in the cylinder 1 is constituted by the path 65 and the opening portion 63.

Furthermore, at an inside of the partition wall 61, a water path 61*a* is provided for communicating a cooling water jacket of the cylinder C2 and a cooling water jacket of the cylinder C4. Furthermore, further, at an upper portion of the partition wall 61, an eaves portion 61*b* is formed extending to the outer side of the V-bank and a projected edge portion 61*c* is formed constituting a front end portion of the eaves portion 61*b* and produced by projecting an edge portion of the opening portion 65*a* of the path 65 on the side of the partition wall 61 over the direction of the rotational axis line L in the lower direction. Furthermore, the opening portion 63 constituting a flow inlet of the breather path 67 and constituting a flow outlet of the return oil path 68, is provided below the partition wall 61 and to a side more proximate to the outer side wall 4R*c* of the V-bank than a side face 61*d* on the side of the return oil path 68 of the partition wall 61 and is disposed at a position at which a portion of the blowby gas flowing from the opening portion 63 impinges on the side face 61*d* and a flow elevating along the side face 61*d* is produced.

Figure 14:
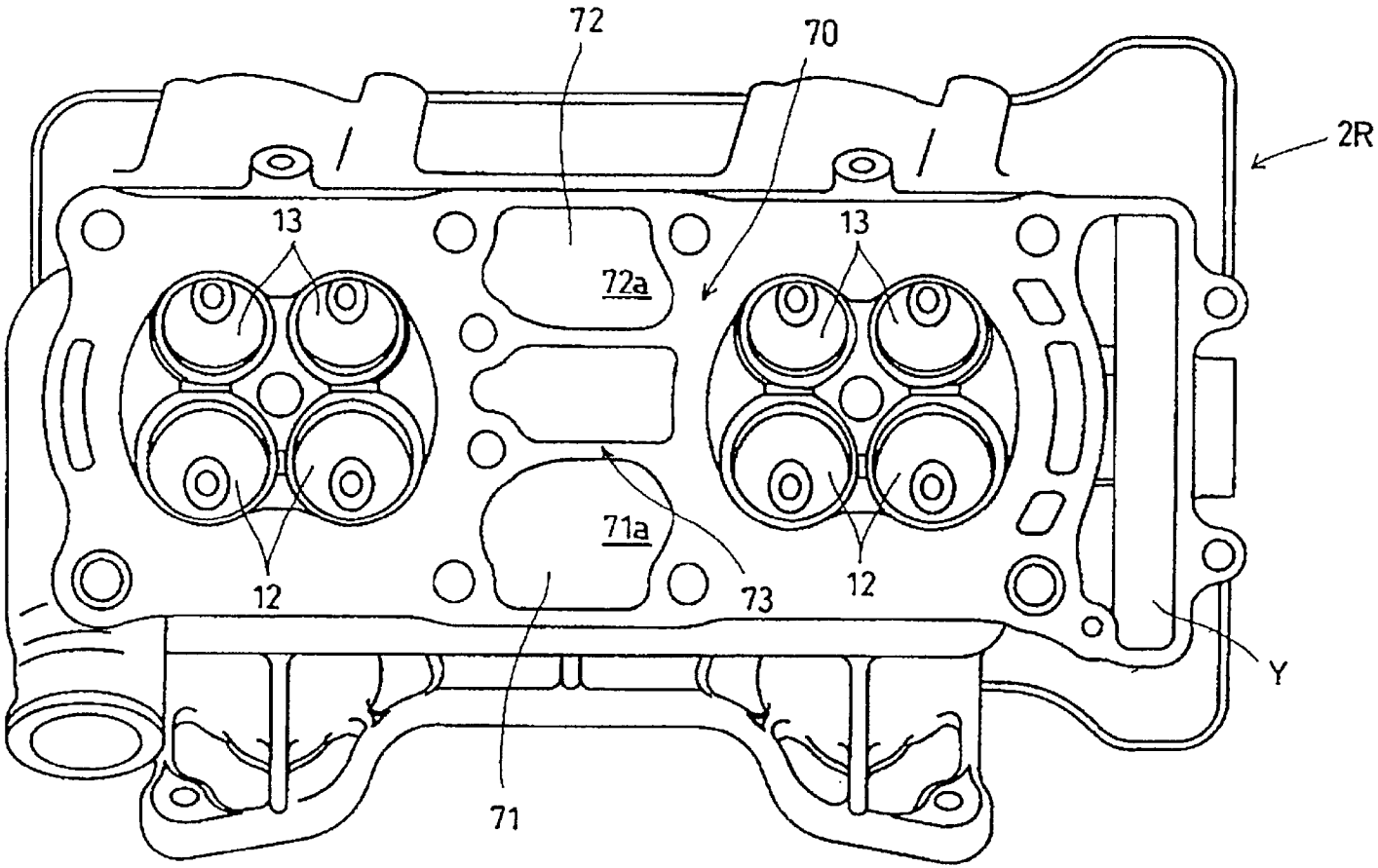
FIG. 14 is a bottom view of a rear cylinder head.

Furthermore, in the rear cylinder head 2R, as illustrated in FIGS. 12 and 14, a space portion 70 is formed at a position in correspondence with the space portion 60. A breather path 71 and a return oil path 72 of the lubricating oil are formed having opening portions 71*a* and 72*a* having sizes respectively matching precisely with the opening portions 64*a* and 65*a* of the path 64 and the path 65 and communicating with inside of the rear valve operating chamber 52R. Furthermore, a partition wall 73 is formed having a lower end face matched with an upper end face of the partition wall 61. At inside of the partition wall 73, a water path 73*a* is formed for communicating a cooling water jacket formed by surrounding the combustion chamber of the cylinder C2 at the rear cylinder head 2R, the ignition plug T and a lower portion of a cylindrical portion 69 (refer to FIG. 2) containing an ignition coil and a cooling water jacket formed by surrounding the combustion chamber of the cylinder C4. The ignition plug T and a lower portion of a pipe contain an ignition coil.

Furthermore, as illustrated in FIGS. 2 and 12, at an upper portion of the rear head cover 3R, above the breather paths 67 and 71, a breather chamber 74 is provided having an inlet 74*a* opened to an inside of the rear valve operating chamber 52R. A recirculating pipe (not illustrated) connected to a connection pipe 75 connected to the breather chamber 74 is connected to an intake path constituting an intake system of the internal combustion engine E.

Thereby, blowby gas in the crankcase 8 sucked by the first through the third scavenge pumps 37 through 39 along with the lubricating oil and discharged into the transmission chamber 9, flows from the transmission chamber 9 into the breather chamber 74 by passing through the breather paths 67 and 71, is recirculated from the breather chamber 74 to the intake path via the recirculating pipe and is supplied to the combustion chamber. Therefore, a breather apparatus is formed for recirculating the blowby gas from the crankcase 8 to the intake path by the first through the third intake ports 41 through 43, the first through the third scavenge pumps 37 through 39, the transmission chamber 9, the breather paths 67 and 71, the rear valve operating chamber 52R, the breather chamber 74, the connection tube 75 and the recirculating pipe.

An explanation will now be given of the operation and effect of the embodiment constituted as described above.

When the internal combustion engine E is operated and the oil pump unit U is operated, the lubricating oil sucked from the oil pan 10 to the feed pump 36 by passing through the oil strainer 34, is delivered from the second delivery port 36*c*, flows into the oil filter 44 by way of the oil path G1 and the introducing oil path G4, is removed of foreign matters or the like by the oil filter 44 and is supplied to the main gallery G8 by passing through the introducing oil path G5, the oil path G6 and the oil path G7.

The lubricating oil flowing from the main gallery G8 into the in-shaft oil path G12 via the oil paths G9, G10 and G11, is supplied to the journals J1 through J4 and the crankpins K1 through K3, lubricates the respective sliding portions, and is injected from the nozzles 51, lubricates the mesh portion and the sliding portions of the drive gear 18, the intermediate gears 19 and the two timing gear trains 20 and 21. Furthermore, the lubricating oil is injected from the nozzles 54 and lubricates the sliding portions of the respective piston pins S1 through S5 and the sliding portions of the respective pistons P1 through P5 and the respective cylinders C1 through C5. In addition, the lubricating oil flowing from the main gallery G8 into the head oil paths G20 and G21, lubricates the sliding portions of the valve operating apparatus VF and VR in the respective valve operating chambers 52F and 52R.

Furthermore, the lubricating oil which has been supplied to the crankcase 8 and has finished lubricating the lubricating portions of the sliding portions and the like described above, flows down to the bottom portion of the crankcase 8 formed between the front wall 6*c* and the inclined partition wall A2*a*, and is sucked from the first through the third intake ports 41 through 43 to the first through the third scavenge pumps 37 through 39. The lubricating oil delivered from the scavenge pumps 37 through 39, is discharged from the first delivery port 40 into the transmission chamber 9, lubricates the lubricating portions of the sliding portions of the multi-plate friction clutch, the gear transmission M and the like and thereafter returns to the oil pan 10. In addition, the oil which has lubricated the drive gear 18, the intermediate gears 19 and the two timing gear trains 20 and 21, returns from the lower portion of the gear chamber 23 opened to the oil pan 10 to the oil pan 10. The lubricating oil supplied to the front valve operating chamber 52F, returns to the oil pan 10 via the return oil paths 55 through 57 and the return pipe 58. The lubricating oil supplied to the rear valve operating chamber 52R returns to the oil pan 10 via the return oil paths 72 and 68 and via the transmission chamber 9. In this way, the lubricating oil supplied into the crankcase 8 is sucked by the first through the third scavenge pumps 37 through 39. Therefore, power loss is not caused by scraping up the lubricating oil by the crankshaft 7.

Furthermore, as described above, blowby gas in the crankcase 8 is sucked to the first through third scavenge pumps 37 through 39 along with the lubricating oil, is discharged into the transmission chamber 9, is recirculated from the transmission chamber 9 to the intake path by way of the breather path 67 formed at the space portion 60, the breather path 71 formed at the space portion 70, the rear valve operating chamber 52R, the breather chamber 74 and the recirculating pipe, is supplied to the combustion chamber and is combusted.

In the rear bank 4R, the space portion 60 formed between the cylinder bore B2 and the cylinder bore B4 at the position opposed to the cylinder bore B3 of the front bank 4F, is provided with a minimum width in the direction of the rotational axis line L to a degree slightly smaller than the diameter of the cylinder bore B3 within a range such that it does not project in the direction of the rotational axis line L relative to the front bank 4F. Therefore, the breather path 67 is provided a sufficiently large flow path area without increasing the width in the direction of the rotational axis line L of the rear bank 4R having a number of cylinders smaller than that of the front bank 4F, and the width in the orthogonal direction. Accordingly, the width in the direction of the rotational axis line L of the cylinder block 1 is not increased, the advantage of the cylinder block 1 being downsized by reducing the width in the direction of the rotational axis line L by coupling the two connecting rods R1 and R2 and the two connecting rods R4 and R5 respectively to the two crankpins K1 and K3 is not deteriorated, and the weight of the cylinder block 1 is reduced. Furthermore, by increasing the flow path area of the breather path 67, a flow rate of the blowby gas flowing in the breather path 67 is kept to a minimum and therefore, an effect of separating lubricating oil mist mixed in the blowby gas is expedited.

The space portion 60 is provided with a width in the direction of the rotational axis line L to a degree slightly smaller than the diameter of the cylinder bore B3 within a range which does not project to the front bank 4F in the direction of the rotational axis line L. Therefore, the return oil path 68 of the lubricating oil having a sufficiently large flow path area can be formed in addition to the breather path 67 having a sufficient flow path area without enlarging the cylinder block 1. Furthermore, lubricating oil from the rear valve operating chamber 52R returns smoothly, the blowby gas and the lubricating oil can be restrained from being mixed with each other by the partition wall 61 partitioning the two paths 64 and 65 in parallel with the direction of the rotational axis line L and an amount of the lubricating oil mist mixed into the blowby gas can be reduced.

By separating the crankcase 8 and the transmission chamber 9 by the partition wall comprising the upper partition wall A1 and the lower partition wall A2, the breather path 67 constituted by the opening portion 63, the path 66 and the path 64 is also separated from the crankcase 8. Therefore, the lubricating oil scattered by rotating the crankshaft 7 does not directly intrude the breather path 67 and the lubricating oil mist is prevented from mixing with the blowby gas.

The partition wall 61 and the partition wall 73 are respectively formed with the water paths 61*a* and 73*a* of cooling water. Therefore, when warming up the internal combustion engine E, the breather paths 67 and 71 are warmed by cooling water from the cooling water jackets of the cylinder block 1 and the rear cylinder head 2R as well as cooling water flowing in the water paths 61*a* and 73*a* of the partition walls 61 and 73. Therefore, condensation of steam at the breather paths 67 and 71 and the breather chamber 74 is prevented and accordingly, water is prevented from mixing wtih the separated lubricating oil and a deterioration of the lubricating oil caused by mixing water can be avoided.

Furthermore, at the upper portion of the partition wall 61, the eaves portion 61*b* extends to the outer side of the V-bank and the projected edge portion 61*c* constitutes the front end portion of the eaves portion 61*b*. Therefore, although a portion of the blowby gas flowed from the opening portion 63 reaches the rear valve operating chamber 52R by passing through the return oil paths 68 and 72, a portion thereof impinges on the side face 61*d* of the partition wall 61 on the side of the return oil path 68 and an elevating flow is produced along the side face 61*d*. Furthermore, the elevating blowby gas impinges on the lower face of the eaves portion 61*b* and the elevating flow is hampered and deflected to the lower side by the projected edge portion 61*c*. Therefore, the flow of the lubricating oil passing through the return oil path 68 is significantly restrained from being hampered by the elevating blowby gas and the lubricating oil flows down to the return oil path 68 smoothly.

Furthermore, the attaching face 45*a* of the attaching seat 45 formed at the front wall 6*c* of the lower crankcase 6, is disposed above the lower end face 6*b* coupled with the oil pan 10 of the lower crankcase 6 and is disposed at a position comparatively higher than that in the case of attaching the oil filter 44 to the oil pan 10 or the case of arranging the oil filter 44 to ride over the lower crankcase 6 and the oil pan 10. Furthermore, the oil filter 44 is formed forward from the assumed plane H and substantially along the assumed plane H and therefore, regardless of presence of the curved wall portion 6*c*1 being bulged forwardly, the attaching face 45*a* can easily be recognized from above. Therefore, attachment and detachment of the oil filter 44 while confirming the attaching face 45*a* are facilitated and the operability of maintenance of the oil filter 44 is promoted. Furthermore, by disposing the attaching face 45*a* rearward from the contact portion 6*c*3 in contact with the assumed plane H on the front side of the curved wall portion 6*c*1 bulged to the front side of the front wall 6*c* of the lower crankcase 6, an amount of projection of the oil filter 44 to the front side is restrained. Therefore, the internal combustion engine E can be downsized and there is increased a degree of freedom of arranging an exhaust pipe connected to the exhaust port 13, extended to the lower side by passing through the front side of the front bank 4F, bent to the left side at the lower side and extended through the space formed to recess the lower portion of the left wall of the oil pan 10 to the right side in the lower direction.

Furthermore, the attaching seat 45 is provided by utilizing the space formed between the front face of the curved wall portion 6*c*1 and the front face of the flat wall portion 6*c*2. Furthermore, the introducing oil path G4 and the introducing oil path G5 are formed at an inside thereof. Therefore, it is not necessary to project the front wall 6*c* of the lower crankcase 6 into the crankcase 8 for forming the oil paths G4 and G5, the inner structure of the crankcase 8 can be simplified, the crankcase can be downsized and accordingly, the internal combustion engine E can be downsized. Furthermoremore, the introducing path G5 formed at a position more remote in the direction orthogonal to the attaching face 45*a* from the attaching face 45*a* directed in the skewed lower direction than the introducing oil path G4, is formed at a vicinity of the lower end portion 6*c*1*a* constituting a comer portion formed by the curved wall portion 6*c*1 and the flat wall portion 6*c*2. Therefore, the inside of the attaching seat 45 can effectively be utilized, an amount of projecting the attaching seat 45 to the front side is reduced and accordingly, an amount of projecting the oil filter 44 to the front side is reduced and the internal combustion engine E can further be downsized.

An explanation will now be given of a modified constitution with regard to an embodiment modifying a portion of the constitution of the above-described embodiment as follows.

Although according to the embodiment, the internal combustion engine E is provided with a hermetically closed crankcase 8, the breather apparatus may communicate with the breather path 67 via a path communicating with the crankcase without hermetically closing the crankcase. In that case, air downstream from an air cleaner of the intake system is introduced into the front valve operating chamber communicating with the crankcase via the path. Furthermore, a PCV valve can be provided at the breather chamber or the output pipe.

Although according to the embodiment, the V-type internal combustion engine E is constituted by 5 cylinders, the internal combustion engine E may be a V-type internal combustion engine having an odd number of cylinders, for example, it may be an internal combustion engine of 3 cylinders or 7 cylinders. Furthermore, in the case of a 3-cylinder V-type internal combustion engine, the space portion of the cylinder block is formed at a position contiguous with a cylinder bore of a bank having an odd number of the cylinder comprising 1 cylinder and by a width in a rotational axis line direction which does not project in the rotational axis line direction of a crankshaft relative to a bank having an even number of cylinders comprising 2 cylinders constituting a bank having a larger number of cylinders.

Furthermore, although according to the above-described embodiment, the first and the third crankpins K1 and K3 are respectively connected with two of the connecting rods R1 and R2 and two of the connecting rods R4 and R5, there may be constituted a V-type internal combustion engine of a style which connects a single connecting rod to a respective crankpin. Furthermore, there may be constituted a V-type internal combustion engine of a style in which crankpins connected with two connecting rods and crankpins connected with a single connecting rod are irregularly present in a rotational axis line direction of a crankshaft.

Furthermore, although the two space portions 60 and 70 are formed with the two paths 64 and 65 respectively divided by the two partition walls 61 and 73, the breather path 71 and the return oil path 72, there may be formed a single path having an opening portion of an area equal to or larger than an area combined with the areas of the opening portions 64*a* and 65*a* of the two paths 64 and 65 without providing the two partition walls 61 and 70 and the path may serve as the breather path and the return oil path. Furthermore, the breather path and the return oil path may be formed only by the partition wall 61 without providing the partition wall 73.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A V-type internal combustion engine, comprising:

a breather apparatus for recirculating blowby gas from a crankcase to an intake system;

a crankshaft, said crankshaft including at least a first, a second and a third crankpin contiguous with each other in a direction of a rotational axis line of said crankshaft;

a cylinder block, said cylinder block being formed with a first and a second bank forming a V-shape;

said first crankpin and said third crankpin are respectively connected with a first and a third connecting rod respectively connected to a first and a third piston respectively fitted in a first and a third cylinder bore formed in the first bank;

said second crankpin is disposed between said first crankpin and said third crankpin, and is connected only with a second connecting rod connected to a second piston fitted to a second cylinder bore formed in the second bank; and said breather apparatus includes a breather path formed in a space portion between the first and the third cylinder bores in the first bank.

2. The V-type internal combustion engine according to claim 1, wherein said space portion is formed with a return oil path for lubricating oil and a partition wall is provided between said breather path and the return oil path for partitioning such that the breather path and the return oil path are in parallel with each other in the direction of the rotational axis line.

3. The V-type internal combustion engine according to claim 2, wherein said partition wall includes a water path formed therein for communicating cooling water jackets of the cylinders adjacent the space portion.

4. A V-type internal combustion engine having an odd number of cylinders, comprising:

a breather apparatus for recirculating blowby gas from a crankcase to an intake system;

a crankshaft, said crankshaft having a first crankpin and a second crankpin contiguous with each other in a direction of a rotational axis line of said crankshaft;

a cylinder block formed with a first bank having an odd number of cylinders and a second bank having an even number of cylinders forming a V-shape;

said first crankpin is connected with a first and a second connecting rod respectively connected to a first and a second piston respectively fitted in a first and a second cylinder bore respectively formed in the first and the second banks;

said second crankpin is connected only with a third connecting rod connected to a third piston fitted to a third cylinder bore formed in a bank of the first and the second banks having a larger number of cylinders; and said breather apparatus includes a breather path formed in a space portion in a bank of the first and the second banks having a smaller number of cylinders.

5. The V-type internal combustion engine according to claim 4, wherein said crankshaft includes a third crankpin contiguous with a side opposite to the side at which the first crankpin is contiguous to the second crankpin, said third crankpin being connected with a fourth and a fifth connecting rod respectively connected to a fourth and a fifth piston respectively connected to a fourth and fifth cylinder bore respectively formed at the first and the second banks, and said space portion is present between the first and the fourth cylinder bores or between the second and the fifth cylinder bores.

6. The V-type internal combustion engine according to claim 4, wherein said space portion is formed with a return oil path for lubricating oil and a partition wall is provided between said breather path and the return oil path for partitioning such that the breather path and the return oil path are in parallel with each other in the direction of the rotational axis line.

7. The V-type internal combustion engine according to claim 5, wherein said space portion is formed with a return oil path for lubricating oil and a partition wall is provided between said breather path and the return oil path for partitioning such that the breather path and the return oil path are in parallel with each other in the direction of the rotational axis line.

8. The V-type internal combustion engine according to claim 6, wherein said partition wall includes a water path formed therein for communicating cooling water jackets of the cylinders adjacent the space portion.

9. The V-type internal combustion engine according to claim 7, wherein said partition wall includes a water path formed therein for communicating cooling water jackets of the cylinders adjacent the space portion.

10. A breather apparatus for recirculating blowby gas from a crankcase to an intake system of a V-type internal combustion engine, said V-type internal combustion engine including a cylinder block formed with a first and a second bank forming a V-shape, said breather apparatus comprising a breather path formed in a space portion directly between first and third cylinder bores in the first bank.

11. The breather apparatus according to claim 10, wherein said space portion is formed with a return oil path for lubricating oil and a partition wall is provided between said breather path and the return oil path for partitioning such that the breather path and the return oil path are in parallel with each other in a direction of a rotational axis line of a crankshaft of the engine.

12. The breather apparatus according to claim 11, wherein said partition wall includes a water path formed therein for communicating cooling water jackets of the cylinders adjacent the space portion.

13. The breather apparatus according to claim 10, wherein said space is bounded by outer circumferences of the first and second cylinder boxes.

14. A breather apparatus for recirculating blowby gas from a crankcase to an intake system in a V-type internal combustion engine having an odd number of cylinders, the V-type internal combustion engine including a cylinder block formed with a first bank having an odd number of cylinders and a second bank having an even number of cylinders forming a V-shape, said breather apparatus comprising a breather path formed in a space portion directly between cylinders in a bank of the first and the second banks having a smaller number of cylinders.

15. The breather apparatus according to claim 14, wherein said space portion is formed with a return oil path for lubricating oil and a partition wall is provided between said breather path and the return oil path for partitioning such that the breather path and the return oil path are in parallel with each other in a direction of a rotational axis line of a crankshaft of the engine.

16. The breather apparatus according to claim 15, wherein said partition wall includes a water path formed therein for communicating cooling water jackets of the cylinders adjacent the space portion.

17. The breather apparatus according to claim 14, wherein said space is bounded by outer circumferences of the cylinders.

18. A breather apparatus for recirculating blowby gas from a crankcase to an intake system of a V-type internal combustion engine, said V-type internal combustion engine including a cylinder block formed with a first and a second bank forming a V-shape, said breather apparatus comprising a breather path formed in a space portion between first and third cylinder bores in the first bank, wherein said space portion is formed with a return oil path for lubricating oil and a partition wall is provided between said breather path and the return oil path for partitioning such that the breather path and the return oil path are in parallel with each other in a direction of a rotational axis line of a crankshaft of the engine.

19. The breather apparatus according to claim 18, wherein said partition wall includes a water path formed therein for communicating cooling water jackets of the cylinders adjacent the space portion.

20. A breather apparatus for recirculating blowby gas from a crankcase to an intake system of a V-type internal combustion engine, said V-type internal combustion engine including a cylinder block formed with a first and a second bank forming a V-shape, said breather apparatus comprising a breather path formed in a space portion between first and third cylinder bores in the first bank, wherein said space portion is formed with a return oil path for lubricating oil and a partition wall is provided between said breather path and the return oil path for partitioning such that the breather path and the return oil path are in parallel with each other in a direction of a rotational axis line of a crankshaft of the engine.

21. The breather apparatus according to claim 20, wherein said partition wall includes a water path formed therein for communicating cooling water jackets of the cylinders adjacent the space portion.

* * * * *